US007466238B2

(12) United States Patent
Kuehnemundt

(10) Patent No.: US 7,466,238 B2
(45) Date of Patent: Dec. 16, 2008

(54) SIGNAL UNIT HAVING AND ACOUSTIC SIGNAL TRANSMITTER

(76) Inventor: Gerhard Kuehnemundt, Elmenstrasse 19, 78576 Emmingen-Liptingen (DE)

( * ) Notice: Subject to any disclaimer, the term of this patent is extended or adjusted under 35 U.S.C. 154(b) by 461 days.

(21) Appl. No.: 11/371,957

(22) Filed: Mar. 10, 2006

(65) Prior Publication Data

US 2006/0206216 A1 Sep. 14, 2006

(30) Foreign Application Priority Data

Mar. 11, 2005 (DE) ..... 10 2005 011 733

(51) Int. Cl.
*G08B 3/00* (2006.01)

(52) U.S. Cl. ..... 340/691.1; 340/933

(58) Field of Classification Search ..... 340/933, 340/562, 539.26, 539.29, 539.1, 51, 691.1; 250/360.1, 35

See application file for complete search history.

(56) References Cited

U.S. PATENT DOCUMENTS

| | | | | |
|---|---|---|---|---|
| 3,984,825 | A | 10/1976 | Fujita | |
| 6,144,289 | A | 11/2000 | LeBel | |
| 6,219,046 | B1 | 4/2001 | Thomas et al. | |
| 2002/0126103 | A1 | 9/2002 | Knowles | |
| 2007/0046145 | A1 * | 3/2007 | Tokumaru et al. | 310/317 |
| 2007/0091084 | A1 * | 4/2007 | Ueshima et al. | 345/419 |

FOREIGN PATENT DOCUMENTS

| | | | |
|---|---|---|---|
| DE | 295 02 266.3 | | 5/1995 |
| DE | 100 58 695 | A1 | 5/2002 |
| DE | 20 2004 011 814 | U1 | 12/2004 |
| DE | 103 42 006 | A1 | 3/2005 |
| EP | 0 318 710 | | 11/1988 |
| EP | 0 621 522 | A | 10/1994 |

* cited by examiner

*Primary Examiner*—George A Bugg
*Assistant Examiner*—Shirley Lu
(74) *Attorney, Agent, or Firm*—Breneman & Georges

(57) ABSTRACT

A signal unit is provided for signaling at least one operating state of a technical device such as a machine, installation, vehicle, or the like, having at least one acoustic signal transmitter (2) for generating an acoustic signal, thereby improving the monitoring of the technical device. This is achieved according to the invention by providing a sensor unit or detecting an acknowledgment of the signal.

20 Claims, 2 Drawing Sheets

SIGNAL UNIT HAVING AND ACOUSTIC SIGNAL TRANSMITTER

Figure 1:
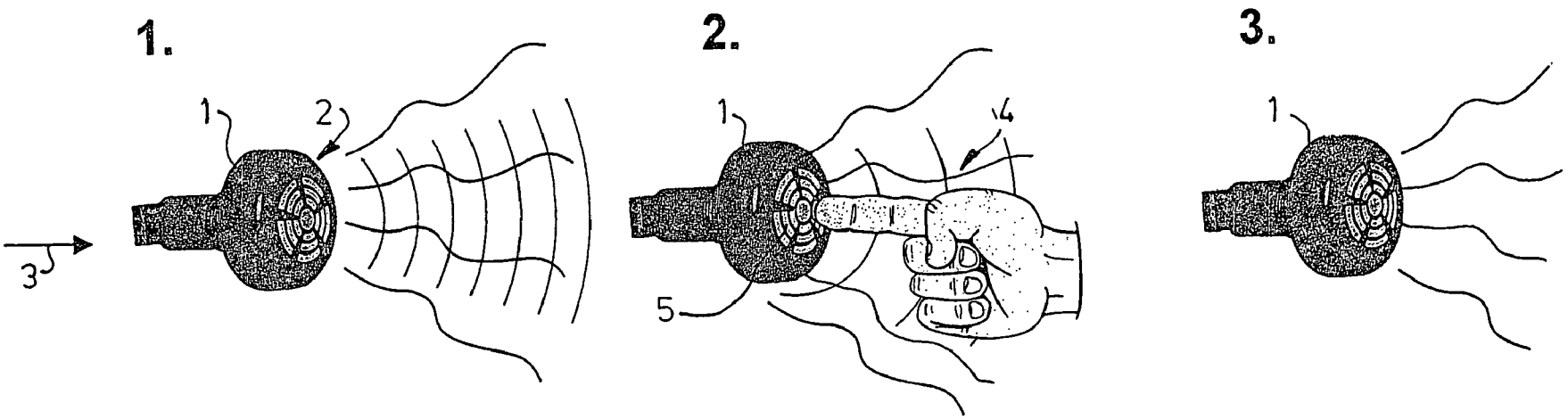

BACKGROUND OF THE INVENTION (1) Field of the Invention

The invention relates to a signal unit for signaling at least one operating state of a technical device such as a machine, installation, vehicle, or the like, having at least one acoustic signal transmitter for generating an acoustic signal. More particularly the invention pertains to a sensing unit for detecting an acknowledgment of the signal.

(2) Description of Related Art Including Information Disclosed Under 37 C.F.R. 1.97 and 1.98

Signal devices are frequently used for signaling operating states of technical devices such as machines, installations, vehicles, or the like. These devices are used, among other purposes, to acoustically and/or optically signal malfunctions of such machines or installations in such a way that the operator is able to recognize and remedy this problem. Such signal devices may also signal operating states that represent hazards for the surroundings or for persons in the surroundings.

Machines or installations are often operated continuously to achieve full capacity utilization. In many manufacturing operations, such machines run essentially automatically, thus requiring few operating and monitoring personnel. The occasional inability to monitor individual machines or installations is unavoidable, and can result in unidentified malfunctions with associated adverse accompanying effects, such as a shutdown, for example, or possibly even leading to hazardous situations.

When an operator perceives the signal or alarm, in many cases the technical device is stopped or the power supply to the technical device is cut off by use of a switch such as an emergency stop switch or the like. The operator then remedies the malfunction and turns the technical device back on or restores the power supply.

BRIEF SUMMARY OF THE INVENTION

The object of the invention is to provide a signal unit for signaling at least one operating state of a technical device such as a machine, installation, vehicle, or the like, having at least one acoustic signal transmitter for generating an acoustic signal, thereby improving the monitoring of the technical device.

Proceeding from a signal unit of the aforementioned type, this object is achieved by a sensing unit for detecting an acknowledgment of the signal. Advantageous embodiments and refinements of the invention are made possible by at least one input element for inputting the acknowledgment by an operator, by having the sensor unit detect a first parameter of the acoustic signal by having the detected parameter at least at the amplitude and/or frequency of the signal, having a control unit in the sensing unit for comparing the target-actual values of the parameter whereby the acknowledgment generates the actual value by having a control unit modify a second parameter of the acoustic signal by modifying the second parameter at least at the volume and/or in the presence of the signal, designing the acoustic signal transmitter to signal the acknowledged operating state, by having at least one optical transmitter designed as a light-emitting diode for generating an optical signal, by having the control unit modify a parameter of a light-emitting diode, by having an optical signal transmitter designed to signal the acknowledged operating state, by having an acoustic signal transmitter that includes at least one piezoelectric element, by having a sensor unit that is designed to detect a contact and/or deformation of the acoustic signal transmitter by having the sensor unit detect the amplitude and/or frequency of the acoustic signal transmitter as a result of contact and/or deformation, by having the acoustic signal transmitter designed as a sensor in the sensing unit to achieve the sensor function and the signal function by having the sensor unit designed as a signal column, by having the acoustic signal transmitter have an acoustic module and/or for the optical signal transmitter having at least one light module and by having at least one transmitting unit with a transmitter for wireless data transmission to a receiver.

Accordingly, a signal unit according to the invention is characterized by the fact that a sensor unit is provided for detecting an acknowledgment of the signal. According to the invention it is possible, for example, for an operator to make use of the acknowledgment of the signaling or warning to implement new functionalities, for example. The control system or control unit of the technical device may be notified in an advantageous manner.

Alternatively or in combination therewith, the signal unit may signal the acknowledged operating state so that, for example, additional persons may be notified that the signaling or warning has been perceived by an operator.

At least one input element for inputting the acknowledgment by an operator is advantageously provided. The input element may be designed, for example, as a contact surface, sensor, microphone, etc., so that an advantageous input of the acknowledgment by the operator may be achieved.

The sensor unit is preferably designed to detect a first parameter of the acoustic signal. In this regard it is possible, for example, to perceive a change in the acoustic signal as acknowledgment, and to advantageously make use thereof for notifying the device control system or the like.

In one advantageous embodiment of the invention, the detected parameter is at least the amplitude and/or the frequency of the signal. The amplitude and/or the frequency of the signal may be detected using commercially available components, for example, thereby enabling the invention to be implemented in a cost-efficient manner.

In one preferred refinement of the invention, the sensor unit includes a control unit for comparing the target-actual values of the parameter, whereby the acknowledgment generates the actual value. In this manner a change in the signal may be detected in an elegant manner. The target value essentially corresponds to the signal before the acknowledgment. It is possible, for example, to dynamically adapt the target value by use of the advantageous control unit. This means that it is not absolutely necessary for a fixed or ideal target value of the signal to be stored in a fixed manner in the control unit, for example, but, rather, the target value may be detected only after the signal is generated, and used for the target-actual value comparison according to the invention. In this case, for example, the target value may be determined fractions of a second after the signal is generated. This advantageously permits a change in the acoustic signal transmitter, i.e., a drift in the signal, in particular due to aging phenomena, etc., without adverse effects on the target-actual value comparison according to the invention.

For example, a change in the parameter by approximately 10%, 20%, or 40%, preferably by approximately 30%, signifies an acknowledgment which may be correspondingly used in an advantageous manner.

The acoustic signal transmitter preferably is designed to signal the acknowledged operating state. By use of this measure it is possible, for example, for persons to perceive the acknowledgment without visual contact.

The control unit is advantageously designed to modify a second parameter of the acoustic signal. In particular, the second parameter to be modified is at least the volume and/or the presence of the signal. In this manner it is particularly simple for the acknowledgment to be perceived, especially by persons.

In one advantageous variant of the invention, at least one optical signal transmitter is provided. On the one hand, this permits optical signaling to be achieved, for example by use of lights in the signal colors, which may be perceived by persons in a particularly simple manner and/or in relatively loud workplaces or the like.

On the other hand, multistage signaling of the signal unit may be achieved by the optical signal transmitter. This means that in a first warning or alarm stage, for example, the optical signal transmitter or the acoustic signal transmitter is in operation, and in a second stage the respective other signal transmitter operates, or both signal transmitters operate simultaneously. Signaling of both signal transmitters could also be used as a third stage.

For example, the optical signal transmitter is designed as a light bulb or the like. The optical signal transmitter preferably is designed as a light-emitting diode for generating an optical signal. Light-emitting diodes are characterized by a particularly long operating life, very low energy consumption, and comparatively compact design. In one particular variant of the invention, multiple light-emitting diodes are provided, thereby enabling, for example, a high luminosity and/or high luminous field, in particular a flashing light, to be realized.

In one particular embodiment of the invention, the control unit is designed to modify a parameter of the optical signal transmitter, in particular the parameter of the light-emitting diode. For example, by use of the control unit it is possible to switch the light-emitting diode on and off, and optionally, to modify the color and/or the luminosity of the light-emitting diode.

The optical signal transmitter advantageously is designed to signal the acknowledged operating state. For example, the acknowledged operating state may be indicated by the above-referenced modifications of the parameter of the light-emitting diode.

In one particular variant of the invention, the acoustic signal transmitter includes at least one piezoelectric element. An acoustic signal may be generated in a particularly simple manner by use of an appropriate piezoelectric element. In addition, use of a piezoelectric element allows an acoustic signal transmitter to be implemented having a comparatively small or compact design, so that the signal unit may similarly have a small design.

Furthermore, use may be made of piezoelectric elements that are already commercially available, thereby implementing the invention in a cost-effective manner. For example, the piezoelectric element is designed as a metal disk having a piezoceramic coating.

Contact or deformation of the acoustic signal transmitter, in particular of the piezoelectric element and/or of the housing for the signal unit, may advantageously be detected by use of the sensor unit, thereby detecting acknowledgment of the signal in a particularly elegant manner. In this case the use of a piezoelectric element is particularly advantageous because the contact or deformation modifies the amplitude and/or frequency of oscillation of the piezoelectric element. This modification may advantageously be perceived by use of a sensor unit or control unit and detected as acknowledgment of the signal according to the invention, in particular by means of the target-actual value comparison according to the invention.

In one particular variant of the invention, the acoustic signal transmitter is designed as a sensor in the sensor unit. This advantageous measure elegantly achieves a multiple function of the acoustic signal transmitter as a sensor for detecting the acknowledgment. This reduces the structural complexity, thereby implementing the invention in a particularly favorable manner. In this way it is also possible to design a particularly small or compact sensor unit according to the invention, thus expanding the areas of application of the inventive signal unit. This is particularly advantageous when space is limited.

In one particular refinement of the invention, the signal unit is designed as a signal column, which in particular in the case of the acoustic signal transmitter has an acoustic module, and/or for the optical signal transmitter has at least one light module. This allows the signal unit to be adapted to very different requirements in a particularly flexible manner.

At least one transmitting unit is advantageously provided with a transmitter for wireless data transmission to a receiver. In this manner, for example, the signal may be acknowledged by the person at a location that is distant from the signal transmitter, in particular the acoustic and/or optical signal transmitter. For example, corresponding signal units are mounted at a comparatively high location on the technical device. In contrast, the signal acknowledgment according to the invention may be positioned at a location on the machine that is easily accessible to the operator without a material connection, i.e., a wire connection or the like, to the signal transmitter being present.

For example, the input element is integrated into a separate assembly which in particular is in wireless connection with the sensor unit or control unit.

BRIEF DESCRIPTION OF THE SEVERAL VIEWS OF THE DRAWING(S)

Figure 2:
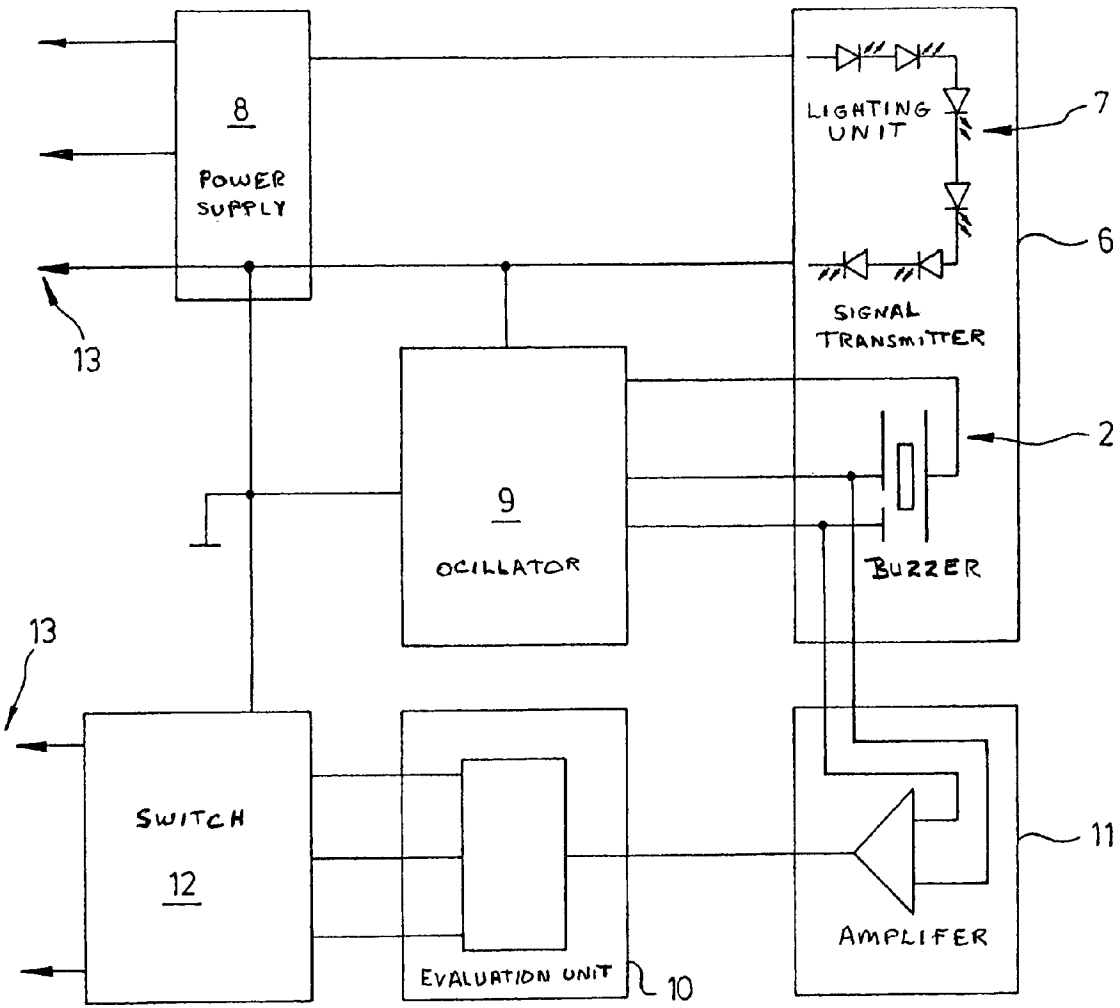

One exemplary embodiment of the invention is illustrated in the drawing, and is explained in greater detail below with reference to the figures, which show the following:

FIG. 1 schematically shows a signal unit according to the invention in various operating stages; and FIG. 2 shows a schematic block diagram of a signal unit according to the invention.

DETAILED DESCRIPTION OF THE INVENTION INCLUDING BEST MODE

FIG. 1 illustrates a signal unit having a housing 1 in which one or more light-emitting diodes (not shown in greater detail) are integrated. The housing 1 is translucent with a red color, for example, so that a red signal light is produced when the light-emitting diode lights up.

The signal unit also has a buzzer 2 designed as a piezoelectric element. The piezoelectric element includes a brass disk with a piezoceramic coating which is designed to buzz or generate an acoustic signal when an alternating electric voltage is applied. The buzzer 2 buzzes at approximately 2 kHz, for example.

For example, the LED lights up as soon as an event 3 is communicated to the signal unit (first alarm stage). In a second alarm stage an additional event 3 is communicated to the signal unit, causing the buzzer 2 to generate an acoustic signal. The alarm with illuminated light-emitting diodes and buzzing buzzer 2 corresponds to stage one according to FIG. 1.

A person 4 perceives the acoustic and/or optical signal, and in stage two of FIG. 1 acknowledges perceiving the signal by touching or pressing the housing 1 in the region of a contact surface 5. As a result, the piezoelectric element 2 is somewhat deformed and thus damped; i.e., the amplitude and/or frequency of the buzzer 2 are modified. This modification is detected by the control unit (not illustrated in greater detail) and evaluated as an acknowledgment. In other words, the buzzer 2 is designed or used both as an acoustic signal transmitter and as a sensor for the acknowledgment. The buzzer 2 or sensor 2 thereby has a dual function, which according to the invention significantly reduces the structural and/or control complexity.

Use may be made of the acknowledgment, for example, by the fact that the technical device to be monitored receives a corresponding electrical signal. The acknowledgment may optionally be logged by the signal unit and/or by the technical device in specific applications, thus allowing the acknowledgment to be checked at a later time.

As a result of the acknowledgment in stage two shown in FIG. 1, by use of the control unit (not illustrated in greater detail) the buzzer 2 may be operated more softly or switched off, and/or the light-emitting diode (not illustrated in greater detail) may be switched off or dimmed.

In the exemplary embodiment illustrated according to FIG. 1, it is seen that in this case in stage three, the buzzer 2 is switched off and the light-emitting diode continues to operate following the acknowledgment.

In this phase (stage three), the malfunction of the technical device, for example, which has occurred and triggered the event 3 is remedied by the person 4.

After the malfunction or error is remedied, an electrical signal is preferably transmitted from the technical device to the signal unit, thereby ending the signaling, for example. In the exemplary embodiment shown, this means that the light-emitting diode (not illustrated in greater detail) is also switched off. The state of the signal unit thereby achieved essentially corresponds to the initial state before the event 3 was communicated to the signal unit.

FIG. 2 schematically illustrates a block diagram of a signal unit according to the invention. A signal transmitter 6 comprises the buzzer as well as multiple light-emitting diodes 7 or a lighting unit 7.

The buzzer 2 is induced to vibrate or buzz by use of an oscillator 9 having an output stage. A power supply 8 provides power for both the lighting unit 7 and the oscillator 9 and buzzer 2, as well as for a switch 12 for the acknowledgment and an evaluation unit 10 comprising a microcontroller and an amplifier 11.

The signal unit is equipped for a terminal strip, for example, by means of connectors 13, thereby allowing an advantageous connection to the technical device and/or to a transmitter or receiver for wireless transmission of electrical signals.

The evaluation unit 10 controls the amplitude and the frequency of the buzzer 2 with the assistance of the amplifier 11. The evaluation unit 10 also compares the amplitude or frequency of the buzzer 2, the values present when the buzzer 2 is switched on being evaluated as the target value.

Referring now to FIG. 1 and FIG. 2 as a result of the contact or slight deformation of the housing 1, and thus of the buzzer 2 mounted or fixed on the housing 1, the amplitude and the frequency of the buzzer 2 are modified slightly, which is detected by the evaluation unit 10 and, for a change of approximately 30%, for example, is evaluated as acknowledgment of the emitted signal. This causes an electrical signal to be generated which is designed, for example, to reduce or modify the volume of the buzzer 2 and/or to modify or reduce the light intensity of the lighting unit 7.

The electrical signal generated as an acknowledgment is also transmitted to, for example, the external control system or control unit of the technical device to be monitored, and is optionally logged.

In the exemplary embodiment described in FIG. 1, the buzzer, for example, is switched off by the acknowledgment, i.e., by contact with the buzzer 2, so that only the lighting unit 7 continues to be illuminated. After the event 3 which resulted in generation of the signal is remedied, the technical device or the external control system, for example, transmits an electrical signal, so that by use of the switch 12 the power supply 8 is disconnected, and thus the optical signal transmitter, i.e., the lighting unit 7, as well as the acoustic signal transmitter, i.e., the buzzer 2, are turned off.

LIST OF REFERENCE NUMBERS

1 Housing
2 Buzzer
3 Event
4 Person
5 Contact surface
6 Signal transmitter
7 Lighting unit
8 Power supply
9 Oscillator
10 Evaluation unit
11 Amplifier
12 Switch
13 Connector

What is claimed is:

1. A signal unit for signaling at least one operating state of a machine, having at least one acoustic signal transmitter for generating an acoustic signal wherein the improvement comprises a dual function sensor unit having an acoustic signal transmitter for generating said acoustic signal and a sensing unit for detecting the acknowledgement of said acoustic signal.

2. The signal unit according to claim 1 further comprising at least one input element for inputting the acknowledgment by an operator.

3. The signal unit according to claim 1 wherein the sensor unit detects a first parameter of the acoustic signal.

4. The signal unit according to claim 1 or 3 wherein said parameter of the acoustic signal is at least the amplitude or the frequency of the signal.

5. The signal unit according to claim 1 wherein the sensor unit has a control unit for comparing the target-actual values of a parameter of the acoustic signal, whereby the acknowledgment generates the actual value.

6. The signal unit according to claim 3 wherein the control unit modifies a second parameter of the acoustic signal.

7. The signal unit according to claim 6 wherein the second parameter to be modified is at least the volume or the presence of the signal.

8. The signal unit according to claim 1 wherein the acoustic signal transmitter signals the acknowledged operating state.

9. The signal unit according to claim 1 further comprising at least one optical signal transmitter having a light-emitting diode for generating an optical signal.

10. The signal unit according to claim 9 wherein the control unit modifies a parameter of a light-emitting diode.

11. The signal unit according to claim 9 wherein the optical signal transmitter signals the acknowledged operating state.

12. The signal unit according to claim 1 wherein the acoustic signal transmitter includes at least one piezoelectric element.

13. The signal unit according to claim 1 wherein the sensor unit detects a contact or deformation of the acoustic signal transmitter.

14. The signal unit according to claim 1 wherein the sensor unit detects the amplitude or frequency of the acoustic signal transmitter as a result of a contact or deformation.

15. The signal unit according to claim 1 wherein the acoustic signal transmitter is a sensor in the sensor unit to achieve the sensor function and the signal function.

16. The signal unit according to claim 1 wherein the signal unit is a signal column.

17. The signal unit according to claim 16 wherein the signal column has an acoustic module for the acoustic signal transmitter or 6 has at least one light module for an optical signal transmitter.

18. The signal unit according to claim 1 further comprising one transmitting unit with a transmitter for wireless data transmission to a receiver.

19. A signaling device for signaling the operating state of a machine comprising:

(a) a piezoelectric element having a dual function of transmitting an acoustic signal and as a sensor for acknowledging the receipt of said acoustic signal; and (b) a translucent housing having one or more light emitting diodes.

20. A signaling device for signalling signaling the operating state of a machine having an acoustic signal transmitter for generating an acoustic signal and a sensor for providing acknowledgment for receipt of said acoustic signal wherein the improvement comprises a dual function acoustic signal transmitter for generating said acoustic signal and a sensing unit for detecting the acknowledgment of said acoustic signal and a translucent housing having one or more light emitting diodes.

* * * * *